US008056727B1

(12) United States Patent
Marsh

(10) Patent No.: US 8,056,727 B1
(45) Date of Patent: Nov. 15, 2011

(54) SHIPPING AND DISPLAY SYSTEMS AND METHODS

(75) Inventor: Craig S. Marsh, High Point, NC (US)

(73) Assignee: Carolina Container Company, High Point, NC (US)

( * ) Notice: Subject to any disclaimer, the term of this patent is extended or adjusted under 35 U.S.C. 154(b) by 0 days.

(21) Appl. No.: 12/850,987

(22) Filed: Aug. 5, 2010

(51) Int. Cl.
*B65D 19/02* (2006.01)
*B65D 5/50* (2006.01)

(52) U.S. Cl. ..... 206/600; 108/56.3; 206/766; 206/774

(58) Field of Classification Search ..... 206/45.28, 206/45.29, 386, 595–600, 736, 766, 765, 206/774; 229/104; 108/56.1, 56.3, 57.16
See application file for complete search history.

(56) References Cited

U.S. PATENT DOCUMENTS 5,383,408 A * 1/1995 Searcy ..... 108/57.16
5,704,488 A * 1/1998 Smith ..... 206/598
6,012,581 A * 1/2000 Galazzo ..... 206/386
6,267,255 B1 * 7/2001 Brush ..... 206/736
6,942,102 B2 9/2005 Justice
7,080,736 B2 7/2006 Jackson et al.
7,182,305 B2 2/2007 Dempsey
7,861,865 B2 * 1/2011 Green ..... 206/600
2010/0012000 A1 * 1/2010 Gordon ..... 108/56.3

OTHER PUBLICATIONS

Corrugated Today, Banishing the "Irritable Diecut" 4 pps, Sep./Oct. 2006.
H.S. Boyd Product Guide, 4 pps, undated related material.

* cited by examiner

*Primary Examiner* — Bryon Gehman
(74) *Attorney, Agent, or Firm* — MacCord Mason PLLC

(57) ABSTRACT

Systems and methods related to an expanding pallet skirt (EPS) are shown and described. In one example, an EPS includes a side including a stabilizer flap (SF), a display flap (DF), and a convertible shelf (CS) positioned between the SF and the DF. The SF has a ship-orientation and a display-orientation. The DF has a ship-orientation and a display-orientation. The CS converts from a shipper-rest-orientation to an expansion-spacer-orientation. Some systems may optionally include a removable shipper-cover configured to interface with the EPS when the DF is in its ship-orientation.

23 Claims, 13 Drawing Sheets

SHIPPING AND DISPLAY SYSTEMS AND METHODS

FIELD OF TECHNOLOGY

The present disclosure relates generally to containers for shipping goods, and more particularly to containers for shipping and displaying goods for sale when positioned on at least one pallet.

BACKGROUND

Warehouse club stores, e.g., Costco Wholesale Corporation and Sam's Club, often sell merchandise in bulk directly off pallets. FIG. 1 illustrates an example of items 2*a* and 2*b* displayed on pallets 4*a* and 4*b*.

Pallets such as 4*a* and 4*b* however are typically designed for storage and transport rather than display for sale. As a result, pallets may be unsightly, for example, dirty or irregular. Some stores may try to improve pallet appearance by painting the pallet, which may be time consuming and expensive.

In addition to single pallet display, as illustrated in FIG. 1, some items, e.g. smaller items, may be displayed on a plurality of pallets to bring the items closer to consumer eye level or reach. FIG. 2 illustrates an example of smaller items 2*c*, e.g. electronics, positioned on a plurality of pallets 4*c*. When a plurality of pallets are used, pallet unsightliness may be emphasized, for example, if multiple unsightly pallets are placed side by side, or when dirty or irregular pallets are placed next to clean or more regularly shaped pallets.

In addition to being unsightly, exposed pallets may represent additional liability, e.g. from large splinters or exposed nails.

Applicants believe that any one or combination of these problems are undesirable and may, for example, distract from sales.

Pallet skirts represent one attempt to address the problem of unsightly pallets. An exemplary pallet skirt may include planar sheets, e.g. of paper, designed to cover each exposed side of the pallet. Such systems may be sufficient when only a single pallet is used. Applicants believe, however, that when multiple pallets are used, existing technologies leave much to be desired and may be difficult to use. For example, if pallets are not flushly vertically aligned, traditional pallet skirts may have a variety of performance problems, for example, at least one of not covering the pallets, buckling, not properly closing, extending outwardly or irregularly. etc.

As a result, Applicants desire systems and methods to address any of the above mentioned, or additional, problems.

SUMMARY

By way of brief summary, the current disclosure is directed to expanding pallet skirts (EPSs), including a variety of systems and methods related to expanding pallet skirts.

In one example, a system includes an expanding pallet skirt (EPS) having a base and a plurality of sides. At least one of the plurality of sides includes a stabilizer flap (SF), a display flap (DF), and a convertible shelf (CS) positioned between the SF and the DF. The SF has a ship-orientation and a display-orientation. The DF has a ship-orientation and a display-orientation. The CS converts from a shipper-rest-orientation to an expansion-spacer-orientation. The EPS creates a new footprint that is larger than the footprint created by the base, thereby allowing the EPS to rest on a plurality of additional pallets that are not flushly vertically aligned with respect to a first pallet.

In some examples, the SF, the DF and the CS of the at least one side are formed from a unitary blank, e.g., of corrugate. In some examples, the EPS will include a plurality of sides, e.g. 2, 3, or 4, each side having a SF, a DF and a CS formed from a unitary blank, In some examples, systems may optionally include a removable shipper-cover configured to interface with the EPS when the DF is in its ship-orientation.

The disclosure is also directed to a plurality of methods, including methods of making EPSs. In one example, a method includes obtaining a plurality of unitary blanks, each having a proximal end and a distal end. The blanks may be scored to create stabilizer flaps (SFs), display flaps (DFs), and convertible shelfs (CSs). The blanks may be connected to a base, thereby forming an EPS.

The disclosure is also directed to methods of shipping. In one example, a method includes obtaining an expanding pallet skirt (EPS). Goods to be shipped may be positioned on the base. The DF may be positioned in its ship-orientation. The CS may be positioned in its shipper-rest-orientation. The SF may be positioned in its ship-orientation. The EPS may be interfaced with a removable shipper-cover.

The above summary was intended to summarize certain embodiments of the present disclosure. Systems and methods will be set forth in more detail in the figures and detailed description below. It will be apparent, however, that the detailed description is not intended to limit the present invention, the scope of which should be properly determined by the appended claims.

DETAILED DESCRIPTION OF TYPICAL EXAMPLES

Figure 1:
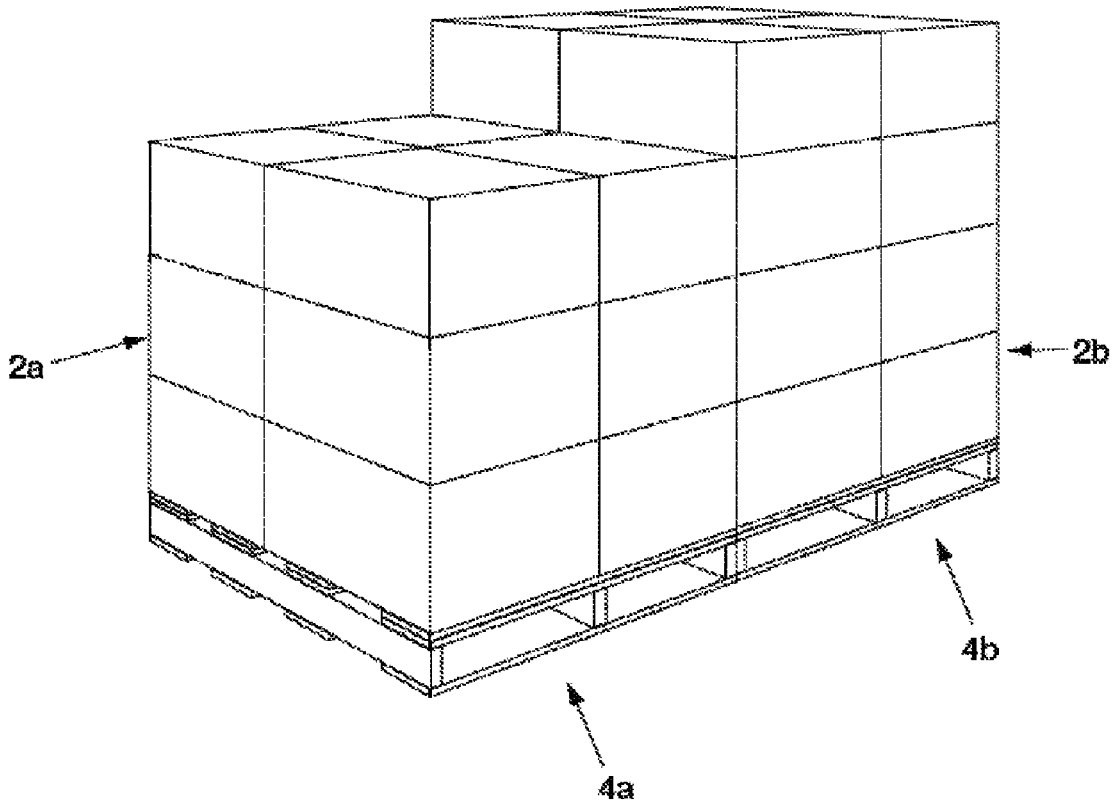
FIG. 1 illustrates background display technology.
Figure 2:
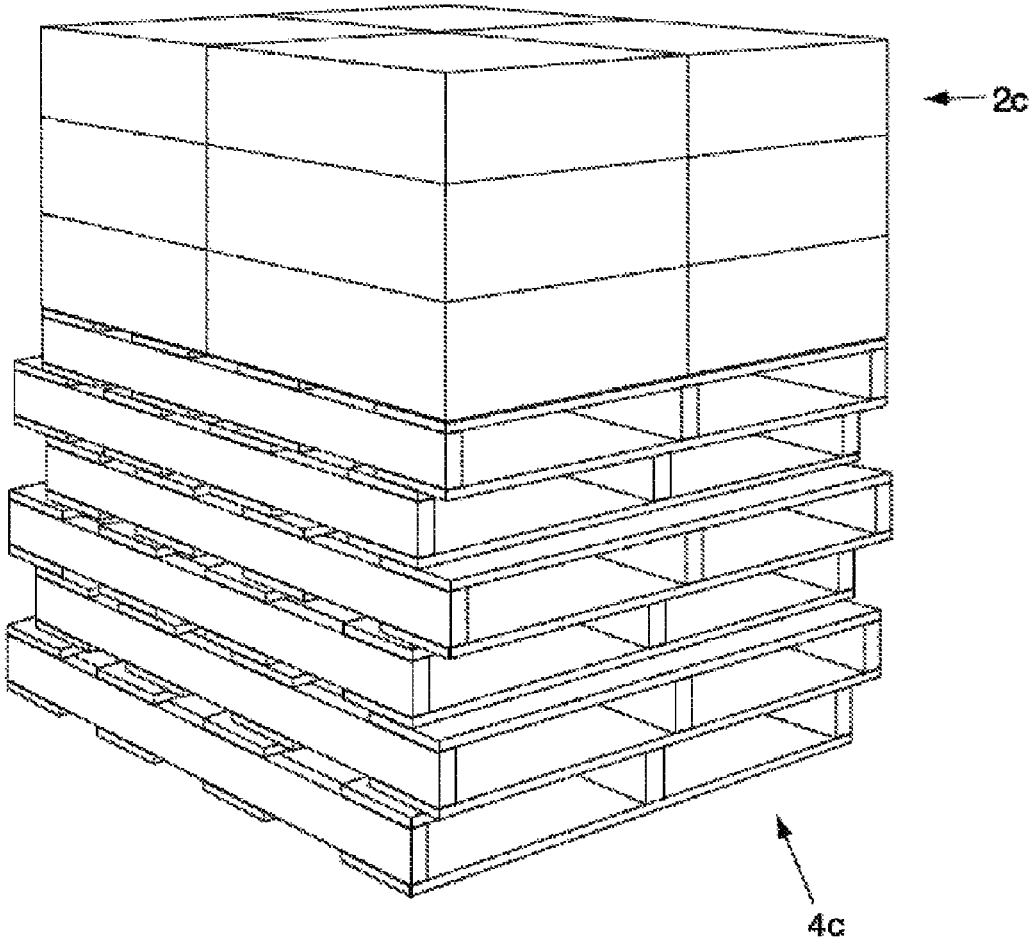
FIG. 2 illustrates another example of background display technology.
Figure 3:
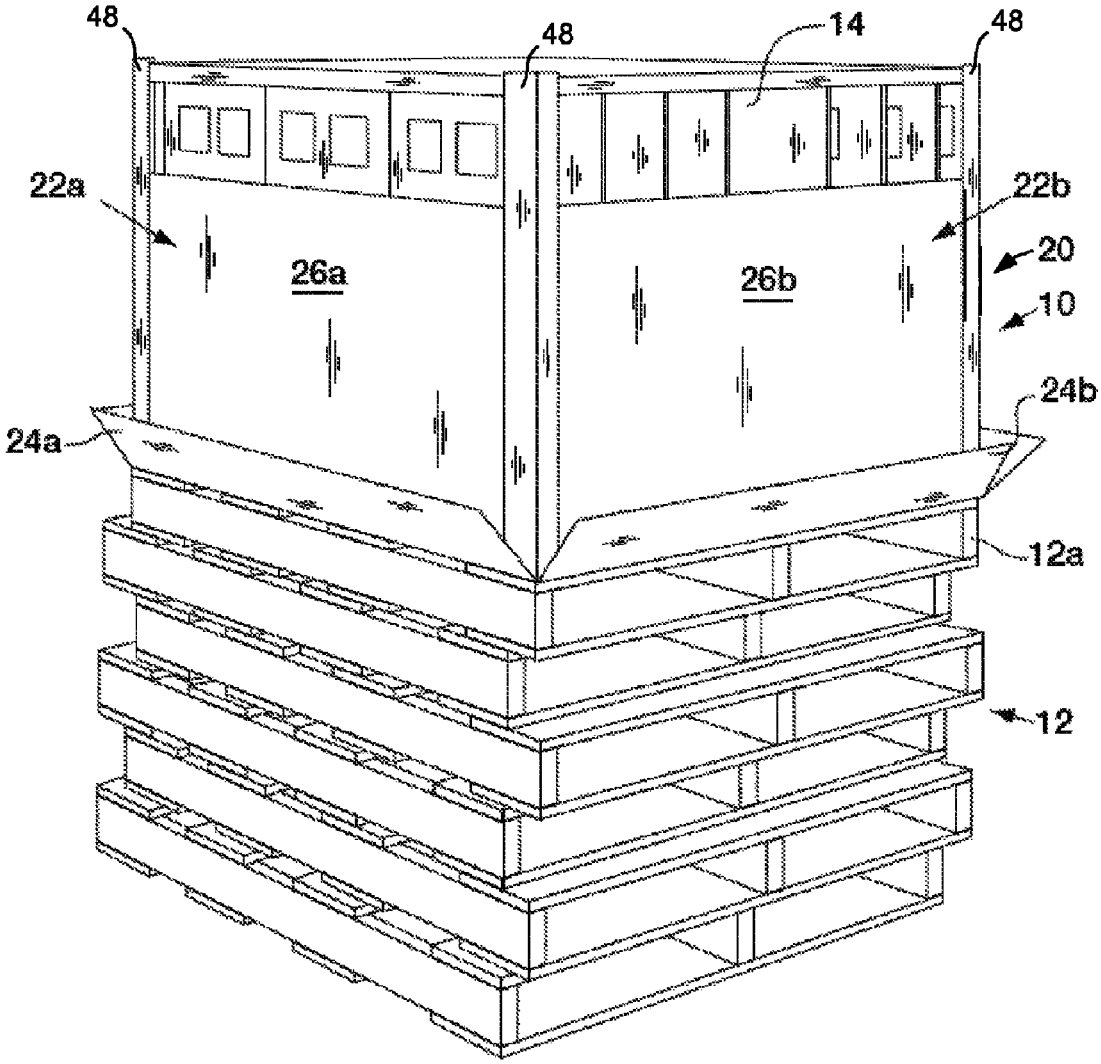
FIG. 3 illustrates one example of a system disclosed herein.
Figure 4:
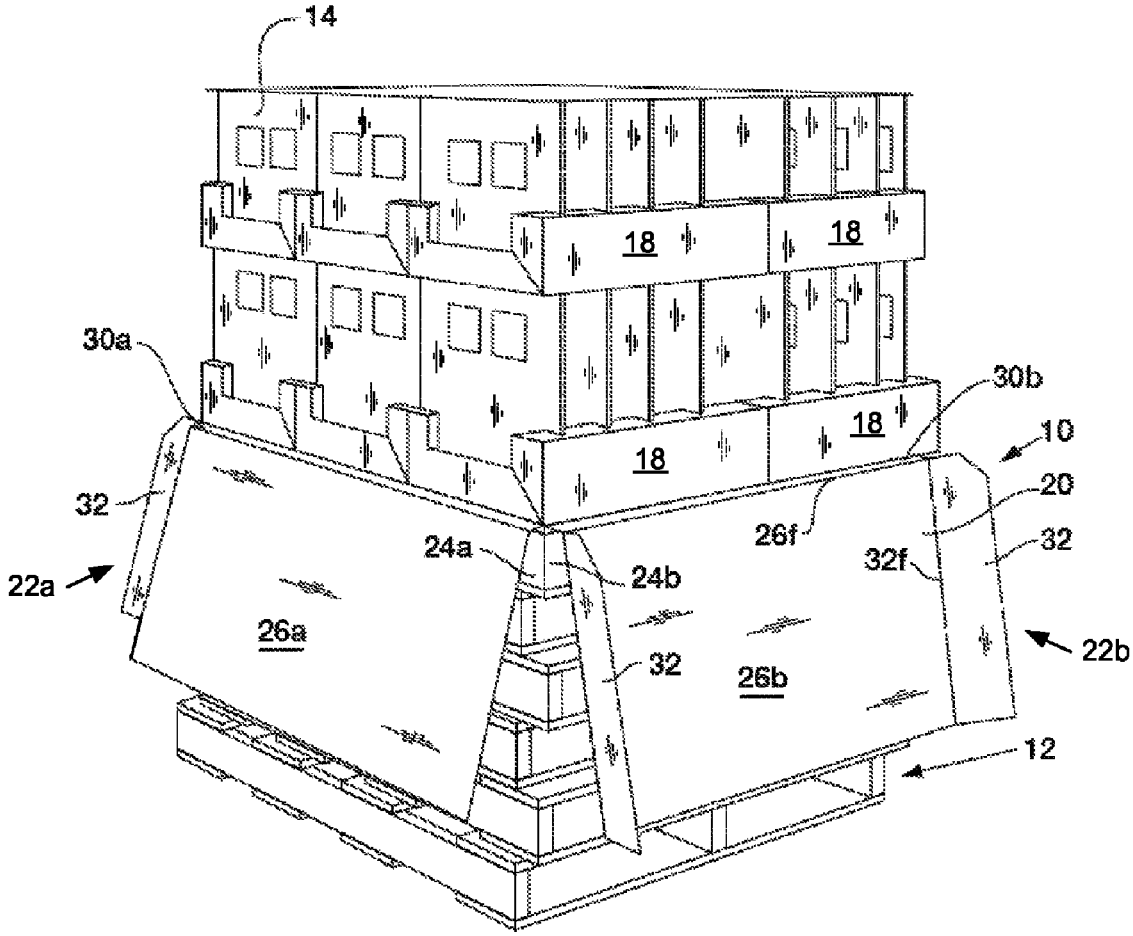
FIG. 4 illustrates the system of FIG. 3 in an alternate configuration.

FIGS. 3 and 4 illustrate one example of a shipping and display system 10, shown in slightly different configurations for illustrating some of the functionality disclosed herein. Also illustrated in FIGS. 3 and 4 are a plurality of pallets 12 upon which system 10 is set, and a plurality of goods 14, e.g., boxes containing electronics, for any combination of shipping, storage and display. Goods 14 are further positioned within racks 18.

System 10 includes an expanding pallet skirt (EPS) 20. EPS 20 may include a plurality of sides 22*a* and 22*b*. At least one of the sides, e.g., side 22*a*, may include a stabilizer flap (SF) 24*a*, a display flap (DF) 26*a*, and a convertible shelf (CS) 30*a* (more visible in FIG. 4) positioned between SF 24*a* and DF 26*a*. EPS 20 may also include a base (exemplary base sheet visible in FIG. 12). More typically, a plurality of sides, e.g., 2, 3, 4, 5, 6, etc., will include a SF, a DF, and CS. For example, in these figures, EPS 20 also includes SF 24*b*, DF 26*b*, and CS 30*b*. The opposite sides of the system may be somewhat similar to 22*a* and 22*b*.

As illustrated, at least one side of the system will have an SF, a DF and a CS that each have a different orientation. For example, in FIG. 3, SF 24*a* is shown in a ship-orientation, DF 26*a* is shown in a ship-orientation, and CS 30*a* (not shown) is in a shipper-rest-orientation (although not visible in this figure). In contrast, in FIG. 4, SF 24*a* is shown in a display-orientation, DF 26*a* is shown in a display-orientation, and CS 30*a* is in an expansion-spacer-orientation The different orientations may vary from example to example. In this example, SF 24*a* is configured to fold upwardly when in its ship-orientation, e.g., as seen in FIG. 3. More typically, SF 24*a* will fold more upwardly than shown in FIG. 3, for example, to abut a removable shipper-cover (discussed below), when that shipper-cover is positioned on CS 30*a*. The foldability of the SF may be achieved in a variety of ways, e.g., by a hinge or flexible plastic. In many examples, the SF will include a score line to facilitate folding.

As illustrated in FIG. 4, SF 24*a* is configured to fold downwardly when in its display orientation. SFs may be folded downwardly such as to interface with at least one pallet positioned below the system, e.g. pallet 12*a*. In FIG. 4, pallet 12*a* is not visible as it is interfaced with and covered by SF 24*a*. The interface of the SF with the pallet may serve, at least in part, to align the EPS over the pallet or plurality of pallets. In this example, the SF has a height that is the approximate height of a pallet, e.g., about 4 inches, but in other examples, the height of the SF may be more or less. For example, the SF may not completely hide pallet 12*a* or may interface with at least one, two, three, or more pallets positioned beneath pallet 12*a*.

Referring back to FIG. 3, DF 26*a* is configured to fold upwardly when in its ship-orientation. As seen, when folded upwardly, DF 26*a* defines, at least in part, a compartment for items 14. DF 26*a* is also configured to fold downwardly when in its display-orientation as illustrated in FIG. 4. The foldability of the DF may be achieved in a variety of ways, e.g., by a hinge or flexible plastic. In many examples, the DF will include a score line to facilitate folding.

In terms of function, when the DF is in its display orientation, it creates a new footprint that is larger than the footprint created by the base, thereby allowing the EPS to rest on a plurality of additional pallets that are not flushly vertically aligned, for example, with respect to pallet 12*a*.

Figure 5:
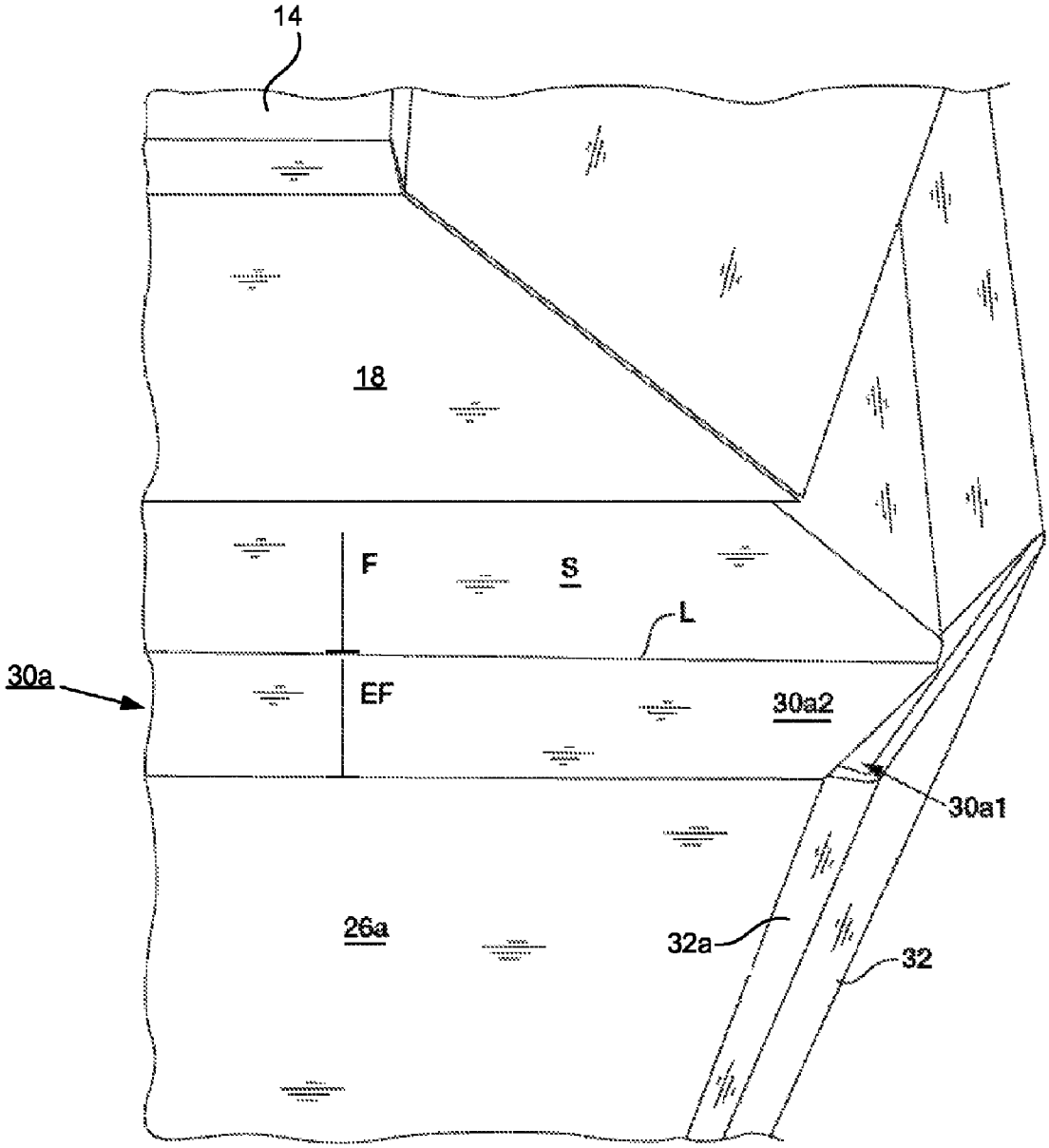
FIG. 5 illustrates a close-up view of a convertible shelf example.

In many examples, the downward folding of the DF converts the CS from its shipper-rest-orientation to its expansion-spacer-orientation, thereby allowing for the larger footprint. FIG. 5, for example, shows a close-up view, of CS 30*a*, which has been converted from its shipper-rest-orientation to its expansion-spacer-orientation by the downward folding of DF 26*a*. The footprint of the base may be considered to extend to F at one side. The conversion of the CS from its shipper-rest orientation to its expansion-spacer-orientation increases the footprint by distance EF. The EF may expand the footprint by a variety of dimensions, for example, at least one of 1, 2, 3, 4, 5, 6, or 7 inches. Other examples include larger or smaller dimensions.

The achievement of expansion may vary from example to example. In this example, CS 30*a* has a first side 30*a*1 pointing downwardly when in said CS is in its expansion-spacer-orientation as shown. As illustrated, first side 30*a*1 is the underside of the upward facing second side 30*a*2. When CS 30*a* is in its shipper-rest-orientation, first side 30*a*1 points upwardly and second side 30*a*2 abuts surface S. Upon conversion, CS 30*a* bends along line L, thereby expanding its footprint. In other examples, other structures may be used to expand the footprint, e.g, sliding or accordion-type CSs.

Figure 6:
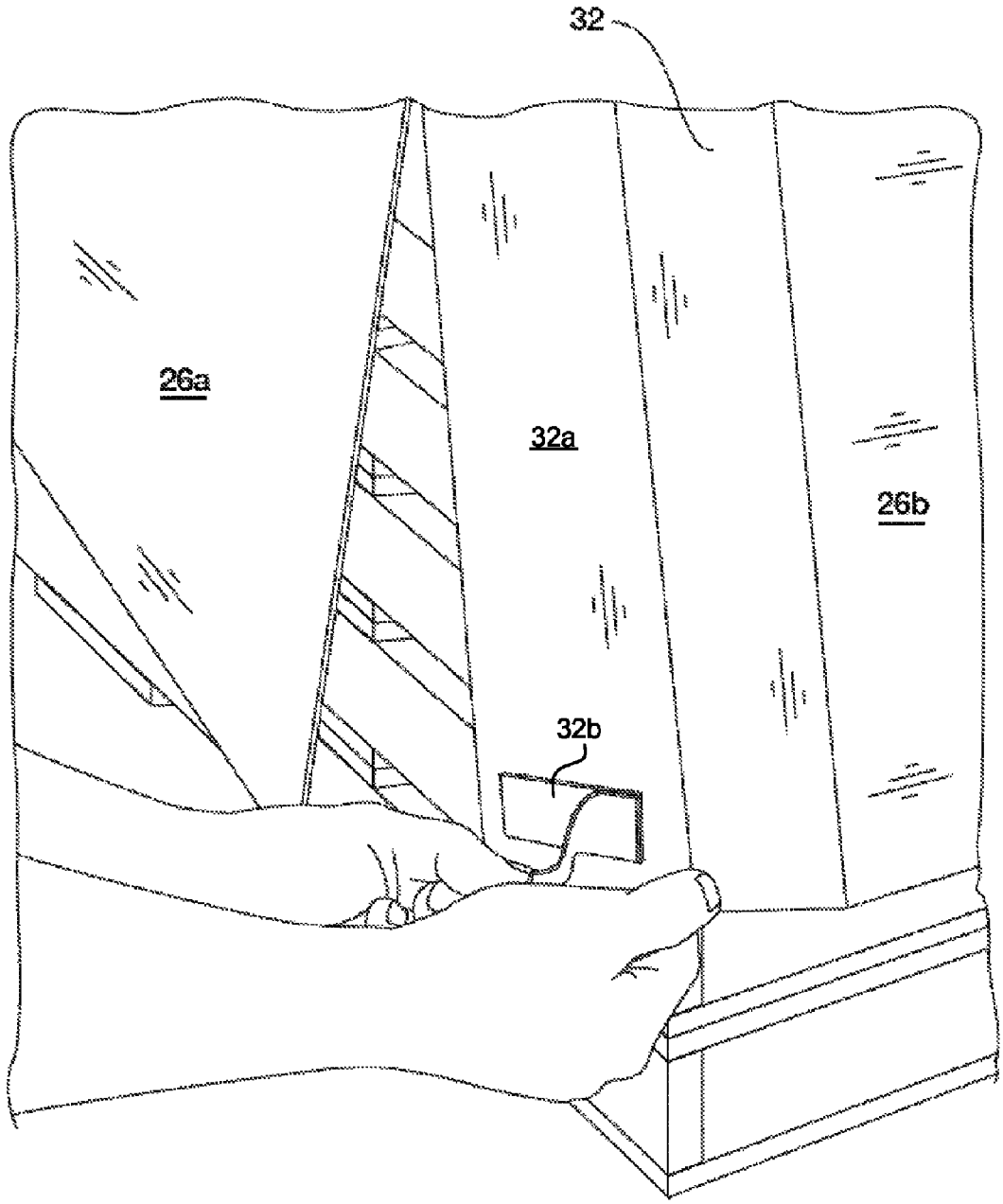
FIG. 6 illustrates a close-up view of a corner flap being interfaced to an adjacent display flap.

Referring to FIGS. 4, 5 and 6, systems may also include at least one corner flap, e.g., flap 32. Corner flaps may perform a variety of functions, including at least one of assisting with the maintenance of system positioning, increasing system rigidity when items are on display, and improving the overall appearance of the system when items are on display. In many examples, corner flaps will be positioned on the DF and configured to fold in a direction perpendicular to the DF's direction of fold. For example, in FIG. 4, DF 26*b* folds along fold line 26*f* and corner flap 32 folds along fold line 32*f*.

In many examples, corner flaps will be configured to attach to an adjacent display flaps. FIG. 6 illustrates an example of corner flap attached to an adjacent display flap. In this example, corner flap 32 includes an interface portion 32*a* for contacting adjacent display flap 26*a*. Here interface portion is an additional fold of corner flap 32, but in other examples, other types of constructions may be used, e.g. straps extending from corner 32, etc. Corner flaps may additionally include a fastener. For example, fastener 32*b* positioned on interface portion 32*a*. Fasteners may be hook and loop, adhesive, snaps, etc.

Figure 7:
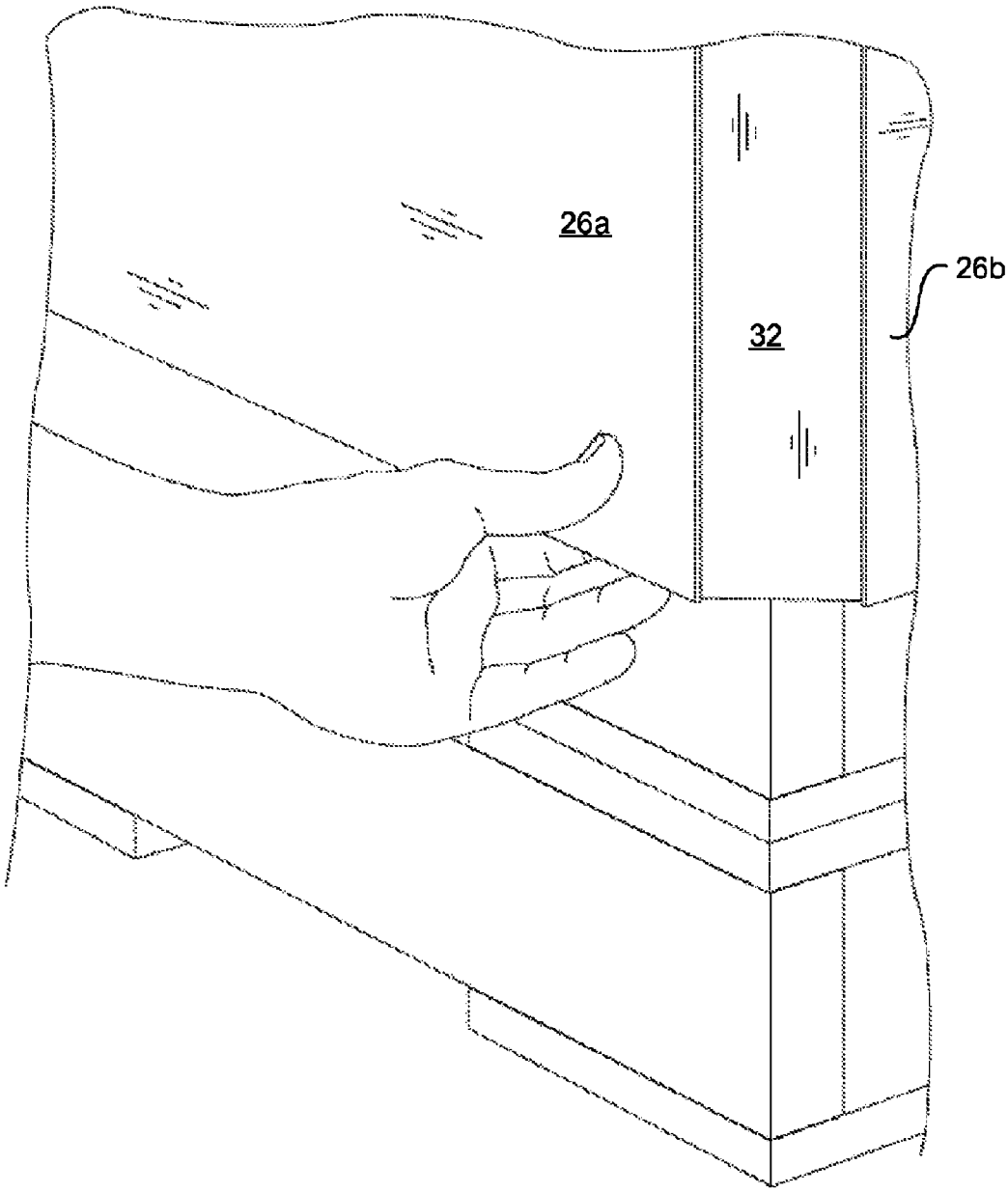
FIG. 7 illustrates an interfaced corner flap.

FIG. 7 illustrates a close-up view of a corner flap 32 that has been interfaced with DF and secured, for example, using fastener 32*b* mentioned previously.

Figure 8:
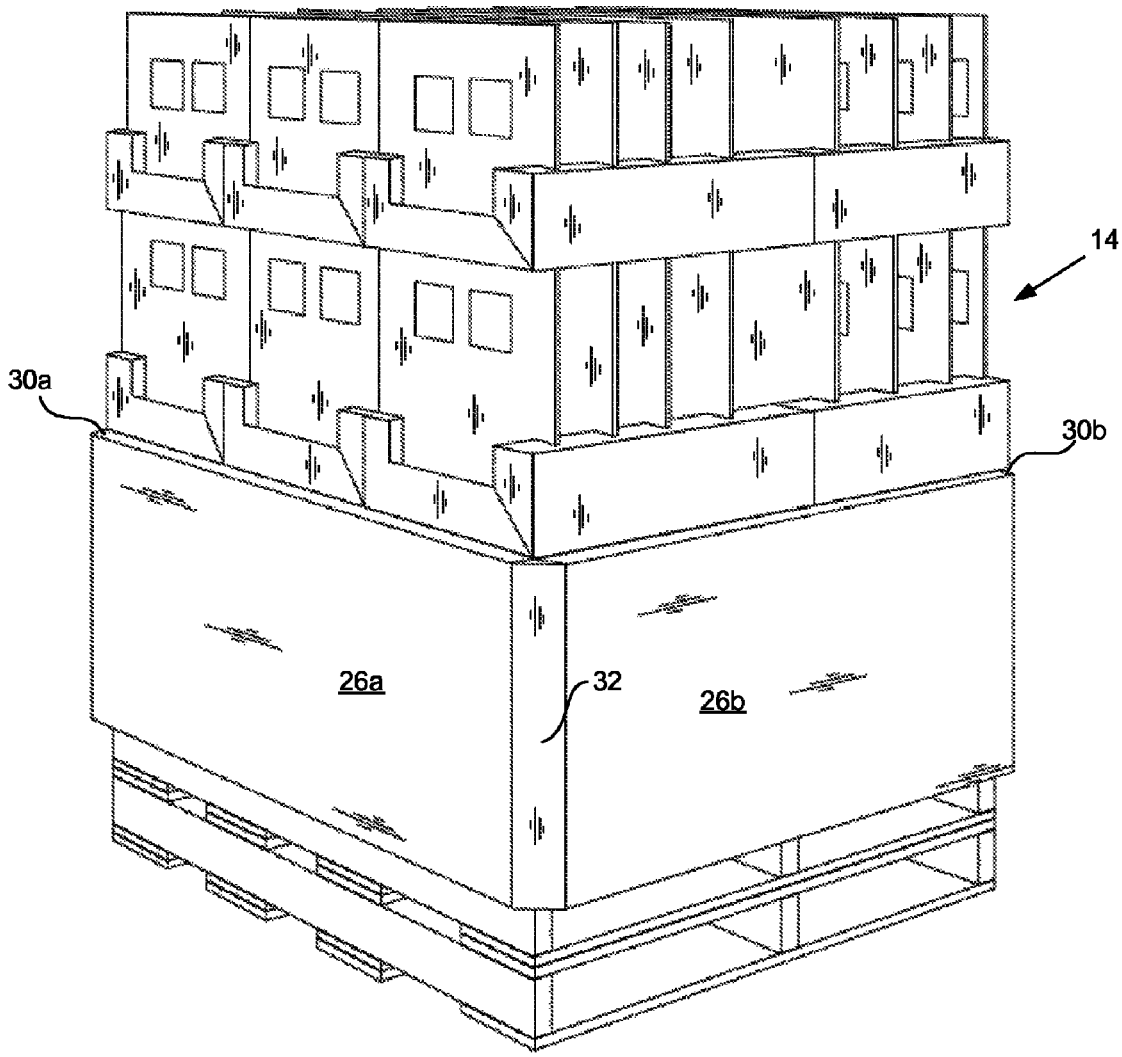
FIG. 8 illustrates a system configured for display.

FIG. 8 illustrates a view of system 10 after SFs (not shown) and DFs 26*a* and 26*b* have been moved to the display position, and CSs 30*a* and 30*b* are in their expansion-spacer-orientation. FIG. 8 illustrates the appearance of a system when items 14 may be offered for sale. As seen, the display is neat and attractive. In some instances, it may also be desirable to add advertising or brand names to DFs, e.g., 26*a* or 26*b*. Such indicia may correspond to items 14, thereby increasing brand name recognition and sale opportunities. In other examples, DFs may contain slots for removably receiving advertising indicia.

Figure 9:
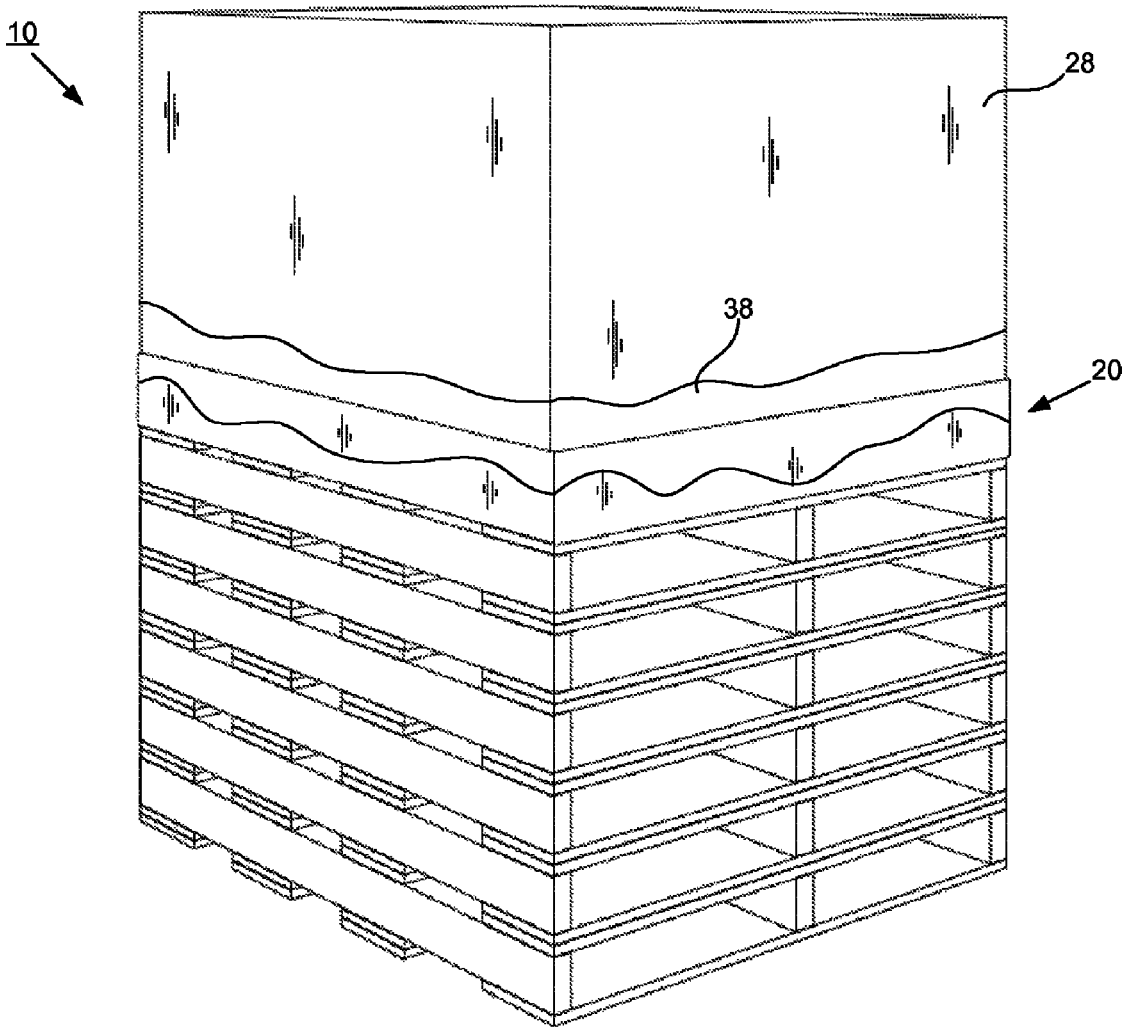
FIG. 9 illustrates a system configured for shipping, with the system including a removable shipper-cover.

FIG. 9 illustrates an example of system 10 in another configuration for shipping or storing items. In this example, EPS 20 is interfaced with a removable shipper-cover 28. By positioning EPS 20 such that the DFs are in their ship-orientation and the CSs are in their shipper-rest orientation (as illustrated in FIG. 3 for example), shipper-cover 28 may be slid over shipped items and be interface with the EPS. Typical examples will include shipper-covers having a height that is tall enough to cover items being shipped. In many examples, shipper-covers will interface by resting on CSs between DFs and SFs. SFs may then be folded up to abut the shipper-cover. SFs may then be secured in their ship-orientation using a variety of methods, e.g., tape, etc. In many examples, SFs may be secured using a biasing wrap, such as a self-clinging film, to surround the system. Using self clinging film may reduce damage to shipper-covers and SFs when removed. Further, the removal of the shipper-cover, in some examples, allows the SFs and DFs to fall into a position similar to seen in FIG. 4, requiring minimal manipulation for set up.

Systems may also include other parts. For example, referring back to FIG. 3, systems may also include corner pieces 48. In this example, corner pieces 48 are positioned outside of DFs along the full length of DFs but in other examples, other configurations may be used. Further, corner pieces may be secured to DFs as desired, e.g., by tape, hook and loop, film, etc. Corner pieces 48 may provide a variety of functions, for example, corner pieces may facilitate interfacing EPSs with shipper-covers by allowing EPSs to slide into proper position. Further, corner pieces may increase the vertical resistance to compression of an assembled system, thereby allowing for multiple systems to be stacked on top of each other with minimal risk of damage to items being shipped. Further, corner pieces may increase the horizontal resistance to compression, thereby reducing risk of damage to items being shipped. Systems disclosed herein may have a variety of shapes and be made from a variety of materials. In many examples, systems or various system components will be made from blanks of some substrate, e.g., corrugate or paperboard, etc. For example, any of the sides, base, shipper-covers, etc. may be pieced together from blanks.

Figure 10:
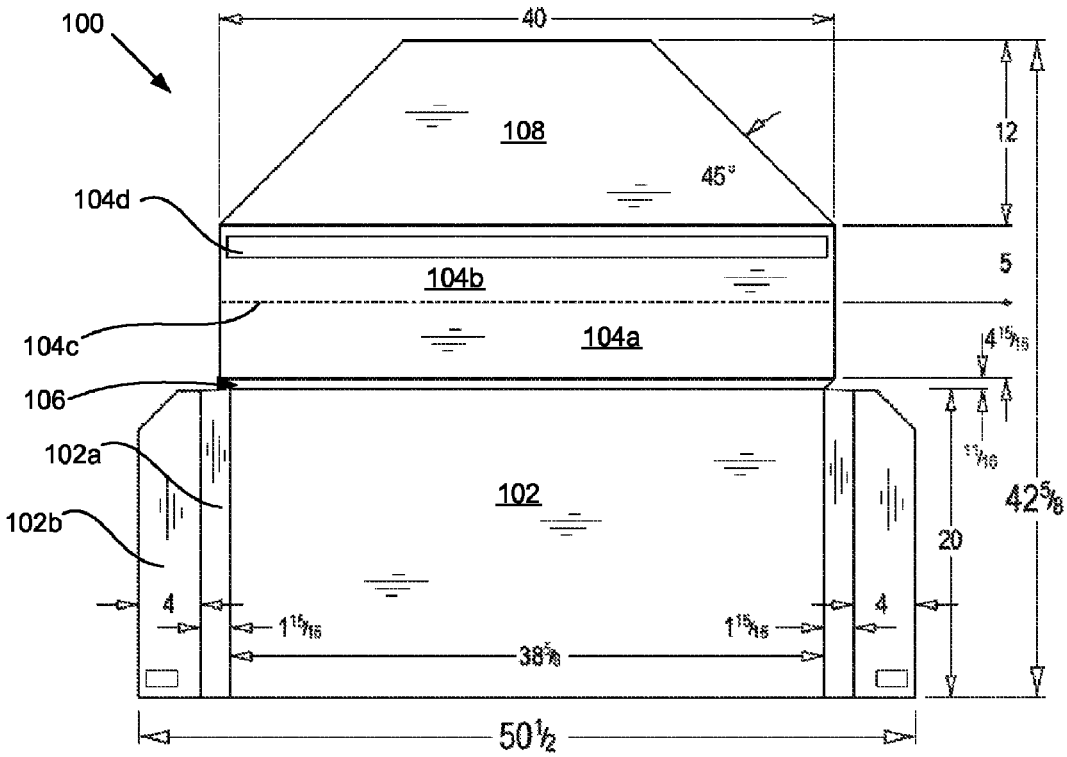
FIG. 10 illustrates an exemplary blank for forming a side of an expanding pallet skirt.
Figure 10:
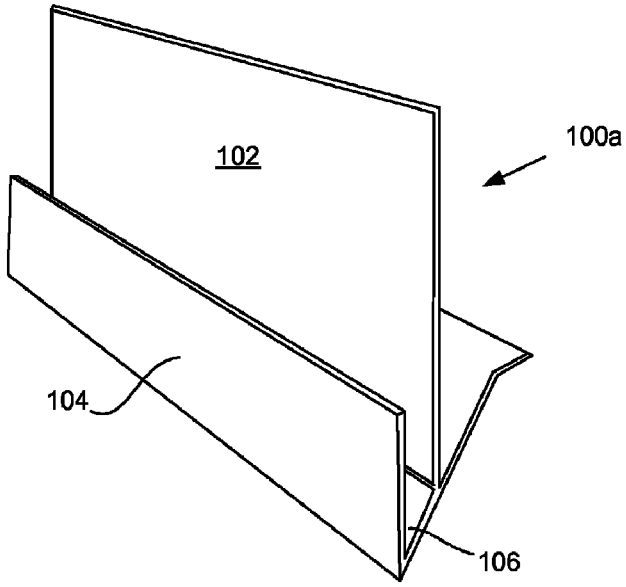

FIG. 10 illustrates one example of blank 100 used to form at least one side of an EPS, e.g., side 26*b* illustrated in FIG. 4. Blank dimensions are provided for illustration and example only. Other examples have other dimensions. Blank 100 may be used to form any of a DF, an SF, and a CS. For example, blank 100 includes DF 102. Blank 100 may also be used form SF by folding portion 104*a* onto portion 104*b* along score 104*c* (which may be a folding score reverse score) and securing along portion 104*d*, e.g. with glue. Blank 100 may also be used to form CS 106 by folding along adjacent score lines. Blank 100 may also be used to form corner flaps 102*a* having interface portions 102*b*. Proximal portion 108 of blank 100 may be the portion attached to a base sheet for example. The portion opposite the proximal portion may be considered the distal portion of the blank.

Schematic 100*a* represents blank 100 folded at the illustrated score lines and as described above to form DF 102, SF 104 and CS 106. The corner flaps are omitted in this schematic to facilitate illustration of the folded conformation.

Figure 11:
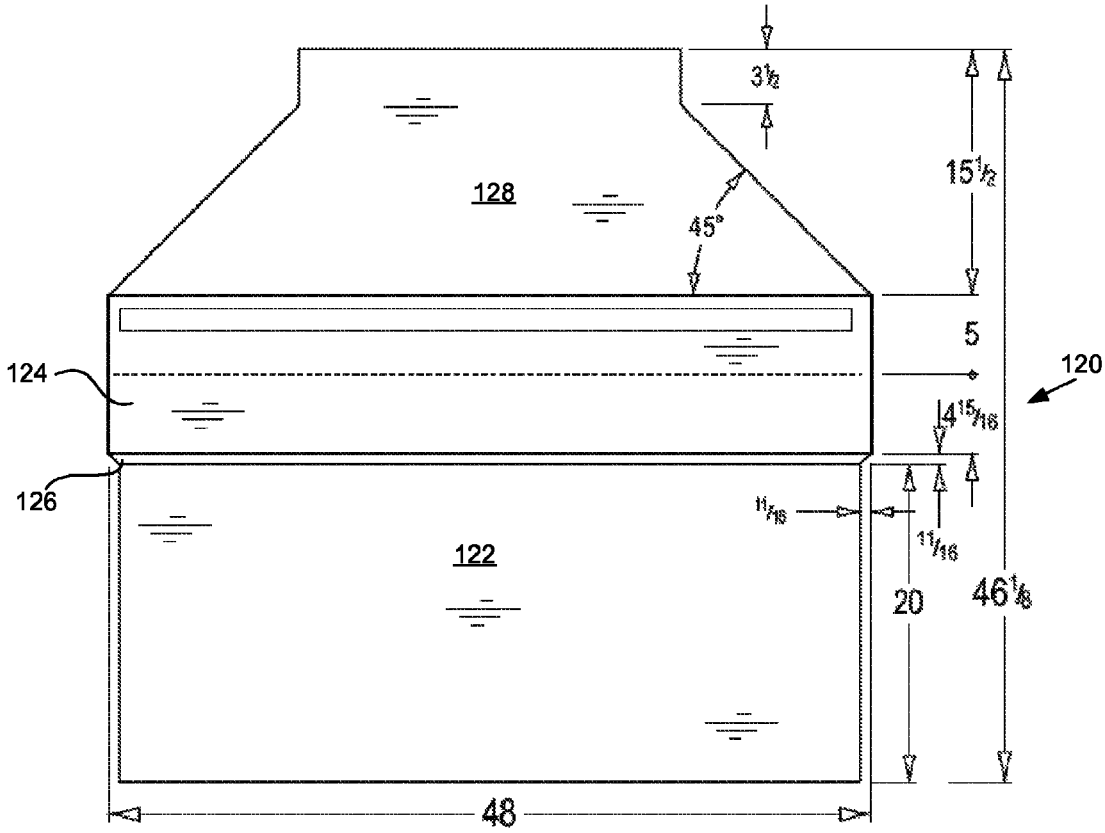
FIG. 11 illustrates another exemplary blank for forming a side.

FIG. 11 illustrates an example of a blank that may be used to form another side, e.g., side 26*a* illustrated in FIG. 4. In this example, blank 120 includes DF 122, SF 124 (which may be formed similarly to described above), and CS 126. Proximal portion 128 may be the portion attached to a base sheet. The folded conformation of blank 120 is readily recognizable based on, inter alia, schematic 100*a*.

Figure 12:
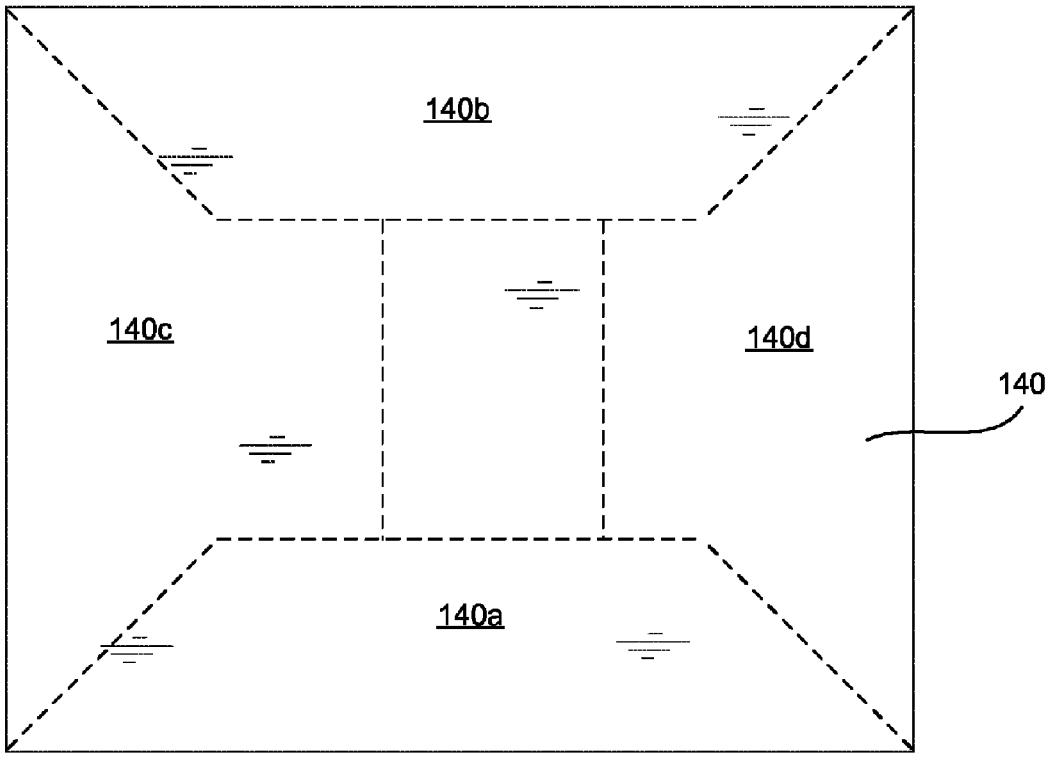
FIG. 12 illustrates an exemplary base sheet.

FIG. 12 illustrates a base component 140 of an EPS. Bases may include a unitary blank sheet as illustrated. In this example, a base may be formed by connecting at least one blank 100 to sheet 140. For example, proximal portion 108 of blank 100 may be attached to portion 140*a* of sheet 140. Additionally, another blank similar to blank 100, may be connected at portion 140*b*. Additionally, another blank similar to blank 120 may be connected by its proximal portion to portion 140*c*, 140*d*, or both. Any combination of the above may be considered a base in some examples. In other examples, bases may be constructed in other ways, e.g., using multiple base sheet components, and may have a variety of different shapes. The resultant base will have a footprint, which may be considered the area occupied by the base.

Figure 13:
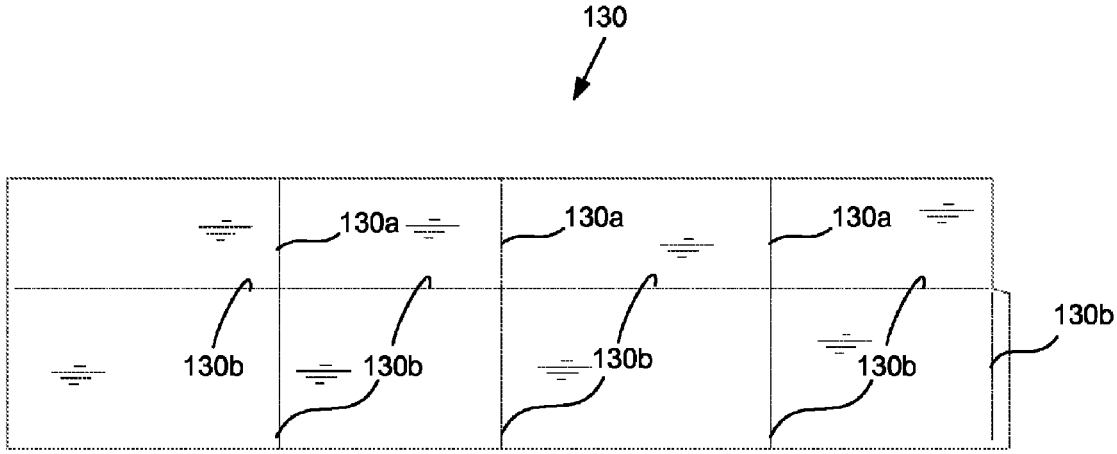
FIG. 13 illustrates an exemplary blank for forming a removable shipper-cover.

FIG. 13 illustrates one example of a blank used to make a shipper-cover. In this example, blank 130 may be cut along lines 130*a* and folded along lines 130*b* to form the shipper-cover.

As noted above, EPS may have one or more sides including a SF, a DF, and a CS. In many examples, particularly, those using 1 EPS per pallet, the EPS will have four sides including a SF, a DF, and a CS. Where multiple EPSs are used per pallet, for example, 2, 3, 4, 5, 6, etc., to display a variety of different products on a single pallet, fewer sides having a SF, a DF, and a CS may be used. For example, sides having a SF, a DF, and a CS may include those sides facing outwardly.

The current disclosure is also directed to methods of shipping and displaying items for sale. In one example, a method includes obtaining any of the EPSs described above. Goods may be positioned on the base of the EPS. A DF is positioned in its ship-orientation. A CS is positioned in its shipper-rest-orientation. A SF is positioned in its ship-orientation. A removable shipper-cover is interfaced with the EPS. The items are ready for shipping or storage. In some examples, corner pieces may be used, as described above. Further, in some examples, at least one of a DF and a SF may be secured with a biasing wrap.

In terms of display, a system containing items may be positioned on a pallet and moved to the desired location for display. The system may be positioned on a plurality of pallets if desired, and there is no requirement that the pallets be completely uniform or flushly aligned. If biasing wrap is present around the SF and shipper-cover, it may be removed. The removable shipper-cover may be removed. If biasing wrap is present around the DF, it may be removed. A DF and SF may then be folded down, thereby converting the CS to its expansion-spacer orientation. The SF may be interfaced with a pallet under the base, and the DF may be folded downwardly to its display potion and secured using corner flaps. There is no requirement for uniform pallets or pallets being flushly, vertically aligned.

Numerous characteristics and advantages have been set forth in the foregoing description, together with details of structure and function. The disclosure, however, is illustrative only, and changes may be made in detail, especially in matters of shape, size, and arrangement of parts, within the principle of the invention, to the full extent indicated by the broad general meaning of the terms in which the general claims are expressed. It is further noted that, as used in this specification, the singular forms "a," "an," and "the" include plural referents unless expressly and unequivocally limited to one referent.

What is claimed is:

1. A shipping and display system for interfacing with a first pallet, said system comprising:

an expanding pallet skirt (EPS) having a base and a plurality of sides, wherein at least one of said plurality of sides includes a stabilizer flap (SF), a display flap (DF), and a convertible shelf (CS) positioned between said SF and said DF, wherein said SF has a ship-orientation and a different display-orientation, wherein said DF has a ship-orientation and a different display-orientation, wherein said CS converts from a shipper-rest-orientation to a different expansion-spacer-orientation, and wherein said DF is configured to fold downwardly when in its display-orientation and create a new footprint that is larger than the footprint created by said base, thereby allowing said EPS to rest on a plurality of additional pallets that are not flushly vertically aligned with respect to said first pallet.

2. The system of claim 1, further including a removable shipper-cover configured to interface with said EPS when said DF is in its ship-orientation.

3. The system of claim 2, wherein said removable shipper-cover is configured to interface with said EPS, at least in part, by resting on said CS when said CS is in its shipper-rest orientation.

4. The system of claim 3, wherein said SF is configured to fold upwardly when in its ship-orientation and abut said removable shipper-cover positioned on said CS.

5. The system of claim 4, wherein said SF includes a score line to facilitate folding.

6. The system of claim 4, further including a biasing wrap, for biasing said SF against said removable shipper-cover positioned on said CS.

7. The system of claim 2, wherein said SF is configured to fold downwardly when in its display orientation and interface with said first pallet, thereby aligning said EPS over said first pallet.

8. The system of claim 1, wherein said DF is configured to fold upwardly when in its ship-orientation and define, at least in part, a compartment for said items for sale.

9. The system of claim 1, wherein said DF includes a score line to facilitate folding.

10. The system of claim 1, wherein the downward folding of said DF converts the CS from its shipper-rest-orientation to its expansion-spacer-orientation.

11. The system of claim 10, wherein said CS has a first side and a second side, wherein said first side is pointing upwardly when said CS is in its shipper-rest-orientation and wherein said first side is pointing downwardly when said CS is in its expansion-spacer-orientation.

12. The system of claim 1, wherein said DF further includes at least one corner flap for maintaining the position of said DF in its display-orientation.

13. The system of claim 12, wherein said DF has a direction of fold and wherein said corner flap is configured to fold in a direction perpendicular to said DF direction of fold.

14. The system of claim 1, wherein said SF, said DF and said CS of said at least one side are formed from a unitary blank having a proximal end and a distal end.

15. The system of claim 14, wherein said base of said EPS includes a base sheet and said unitary blank is attached at is proximal end to said base sheet of said EPS.

16. The system of claim 14, further including at least one of:

one additional side comprising an SF, a DF and a CS positioned between said SF and said DF;

two additional sides, each comprising an SF, a DF and a CS positioned between said SF and said DF; and three additional sides, each comprising an SF, a DF and a CS positioned between said SF and said DF.

17. The system of claim 16, wherein at least said DF and said one additional DF are configured to be connected when in their display-orientation.

18. A shipping and display system for shipping, interfacing with a first pallet, and displaying items for sale when positioned on a first pallet and a plurality of additional pallets, said system comprising:

a removable shipper-cover; and an expanding pallet skirt (EPS) having a base and four sides, wherein each of said four sides includes a stabilizer flap (SF), a display flap (DF), and a convertible shelf (CS) positioned between said SF and said DF;

wherein each of said four SF has a ship-orientation and a display-orientation and is configured to fold upwardly when in its ship-orientation and abut said removable shipper-cover, and is configured to fold downwardly when in its display orientation and interface with a first pallet;

wherein each of said four DF has a ship-orientation and a display-orientation, and is configured to fold upwardly when in its ship-orientation and define, at least on part, a compartment for said items for sale, and is configured to fold downwardly when in its display-orientation;

wherein each of said four CS has a first side and a second side and converts from a shipper-rest-orientation to an expansion-spacer-orientation, said first side pointing upwardly when said CS is in its shipper-rest-orientation and pointing downwardly when said CS is in its expansion-spacer-orientation;

wherein the downward folding of said four DF moves said four CS from their shipper-rest-orientation to their expansion-spacer-orientation; and wherein, when said DF are in their display orientation, they create a new footprint that is larger than the footprint created by said base, thereby allowing said EPS to rest on a plurality of additional pallets that are not flushly vertically aligned with respect to said first pallet.

19. The system of claim 18, wherein each of said four sides is formed from a unitary blank having a proximal end and a distal end.

20. The system of claim 18, wherein at least one of said four DF has a direction of fold and includes a corner flap configured to fold in a direction perpendicular to said DF direction of fold and interface with an adjacent DF for maintaining the position of said DF in its display-orientation.

21. A method of making an expanding pallet skirt (EPS) for use in a shipping and display system for shipping, interfacing with a first pallet, and displaying items for sale, said method comprising:

obtaining a plurality of unitary blanks, each having a proximal end and a distal end;

for at least one blank, using a plurality of score lines to create a stabilizer flap (SF), a display flap (DF), and a convertible shelf (CS) positioned between said SF and said DF; and connecting said at least one blank having a SF, a DF and a CS to a base sheet in a manner that allows the downward folding of said DF to move said CS from its shipper-rest-orientation to its expansion-spacer-orientation, thereby expanding the footprint of said base and allowing said EPS to rest on a plurality of display pallets that are not flushly vertically aligned with respect to said first display pallet.

22. A method of shipping and display items for sale, said method comprising:

obtaining an expanding pallet skirt (EPS) having a base and a four sides, each of said four sides including a stabilizer flap (SF), a display flap (DF), and a convertible shelf (CS) positioned between said SF and said DF, wherein at least one of said four SF has a ship-orientation and a display-orientation and is configured to fold upwardly when in its ship-orientation and abut said removable shipper-cover, and is configured to fold downwardly when in its display orientation and interface with a first pallet;

wherein at least one of said four DF has a ship-orientation and a display-orientation, and is configured to fold upwardly when in its ship-orientation and define, at least in part, a compartment for said items for sale, and is configured to fold downwardly when in its display-orientation;

wherein at least one of said four CS has a first side and a second side and converts from a shipper-rest-orientation to an expansion-spacer-orientation, said first side pointing upwardly when said CS is in its shipper-rest-orientation and pointing downwardly when said CS is in its expansion-spacer-orientation, and wherein the downward folding of said at least one DF moves said at least one CS from its shipper-rest-orientation to its expansion-spacer-orientation, thereby expanding the footprint of said base and allowing said EPS to rest on a plurality of display pallets that are not flushly vertically aligned with respect to said first display pallet;

positioning goods to be shipped on said base;

positioning said at least one DF in its ship-orientation;

positioning said at least one CS in its shipper-rest-orientation; and interfacing said EPS with a removable shipper-cover.

23. The method of claim 22, further including positioning said EPS with said interfaced removable shipper-cover on at least a first display pallet;

removing said removable shipper-cover;

folding said at least one SF downwardly to its display-orientation to interface with said first display pallet, folding said at least one DF downwardly to its display-orientation, thereby expanding the footprint of said base.

* * * * *